United States Patent [19]

Shigenobu et al.

[11] 4,369,729

[45] Jan. 25, 1983

[54] IMAGE RECORDING APPARATUS

[75] Inventors: Michio Shigenobu, Tokyo; Masaharu Ohkubo, Yokohama, both of Japan

[73] Assignee: Canon Kabushiki Kaisha, Tokyo, Japan

[21] Appl. No.: 291,632

[22] Filed: Aug. 10, 1981

[30] Foreign Application Priority Data

Aug. 18, 1980 [JP] Japan ..... 55-113228
Aug. 18, 1980 [JP] Japan ..... 55-113229

[51] Int. Cl.[3] ..... B05C 11/00

[52] U.S. Cl. ..... 118/60; 118/70; 118/101; 430/98; 430/99; 430/124; 432/60; 432/228; 355/3 FU

[58] Field of Search ..... 118/60, 70, 101; 432/60, 228; 430/99, 98, 124; 355/3 FU

[56] References Cited

U.S. PATENT DOCUMENTS 2,990,278 6/1961 Carlson ..... 430/124
3,206,307 9/1965 Ludwig ..... 430/124

*Primary Examiner*—Bernard D. Pianalto
*Attorney, Agent, or Firm*—Fitzpatrick, Cella, Harper & Scinto

[57] ABSTRACT

An image recording apparatus including an image forming station for causing an image bearing member to bear an unfixed image, a fixing station for fixing the unfixed image on the image bearing member, a transport member for transporting the image bearing member from the image forming station to the fixing station, and support device for supporting the transport member; wherein the transport member is provided with a second resistivity in the part thereof which is in contact with the image bearing member and with a first resistivity in other part thereof, the first and second resistivities being so selected as not to disturb the unfixed image on the image bearing member.

20 Claims, 6 Drawing Figures

IMAGE RECORDING APPARATUS

BACKGROUND OF THE INVENTION

1. Field of the Invention

The present invention relates to an image recording apparatus in which an unfixed image is borne by an image bearing member and is then fixed onto said image bearing member, and more particularly to an image recording apparatus in which the unfixed image is electrically borne by the image bearing member.

2. Description of the Prior Art

In conventional image recording apparatus such as electrophotographic apparatus, the transport means for transporting an image bearing member on which an unfixed image is deposited in an image depositing station, for example an image transfer station, from said image depositing station to a fixing station is generally provided with guide members positioned close to said fixing station for guiding said image bearing member having said unfixed image into said fixing station, and there have been proposed various improvements on said guide members for preventing wrinkles eventually formed on said image bearing member in said fixing station or defective image fixation resulting from eventual scattering of the unfixed image. However such improvements on the guide members for guiding the image bearing member in sliding motion to the fixing station have principally been directed to the reduction of the contact resistance with the image bearing member or to the facilitated introduction of the image bearing member into the paired fixing rollers by means of modified shape of the guide members, and there have been proposed no improvements on the guide members relating to the electric charge borne by the image bearing member.

Also with respect to other members relating to the transport between said image depositing station to the fixing station, there have been proposed no improvements based on electrical analysis for example of the scattering of the unfixed image.

It has however been found that the electrical properties of such guide members are of unignorable importance for further improvement of the image quality. For example a visible image formed on a photosensitive drum after image development is subjected to a high voltage of ca. 7 kV by a transfer charger in the image transfer step onto an image bearing member in an electrophotographic copier to provide the image bearing member, from the rear face thereof not facing the photosensitive drum, with a charge of a polarity opposite to that of the developer, whereby the visible image of said developer is transferred from said photosensitive drum to the image bearing member, thus forming an unfixed image thereon. In the above-mentioned procedure the image bearing member is given a charge of ca. 1 kV on the rear face thereof. Said charge on the rear face, though being variable by the voltage applied by said transfer charger, by the spacing of the image bearing member or by the area of image bearing member occupied by the developer, is generally larger than that on the face bearing the unfixed image. Consequently the image bearing member having the unfixed image is electrically unbalanced with respect to the amounts of charge present on the front and rear faces thereof.

The image bearing member in such state can be stably transported for example on a conveyor belt because of electrostatic adhesion of the image bearing member to the conveyor belt. However, at the transfer of the image bearing member with the unfixed image from said conveyor belt to the guide members of the fixing station, there results frictional charging because of the frictional contact between said image bearing member and said guide members. In order to reduce the contact resistance there has been proposed to provide the contact face of said guide member with ribs or with a Teflon coating.

There have however been found certain difficulties which cannot be avoided by such improvements. In case the developer constituting the unfixed image is of a weak coagulative force between the developer particles or of a weak adhesive force to the image bearing member due to a weak electrostatic charge of the developer, the unfixed image is susceptible to the effect of external or above-mentioned frictional charge, causing deterioration, such as scattering, of the image. In case said guide members are electroconductive, the charge present on a face of the image bearing member contacting said guide members is dissipated to said guide members, and the resulting electric field disturbs the image. On the other hand in case said guide members are made of a highly insulating material, the charge resulting from the above-mentioned frictional charging is gradually accumulated on a face of the guide member contacting the image bearing member, giving rise to an electric field causing a perturbation to the unfixed image. Furthermore, if it is attempted to eliminate said charge or the charge present on the rear face of the image bearing member, the image may again be disturbed by an electric field eventually formed at such elimination. Such charge accumulation also depends significantly on the charge present on the face of the image bearing member contacting said guide members, in addition to that resulting from the frictional charging. Such difficulties are also observable in case the particles constituting the unfixed image have a strong adhesive force among themselves or to the image bearing member.

SUMMARY OF THE INVENTION

The object of the present invention is to provide a transport member capable of preventing the above-mentioned drawbacks and providing a superior image without scattering or disturbance thereof.

More specifically the object of the present invention is to provide a transport member having first and second resistivities ensuring a charge relationship not affecting the unfixed image from the deposition thereof onto the image bearing member until the fixation thereof on said image bearing member.

DETAILED DESCRIPTION OF THE PREFERRED EMBODIMENTS

Figure 1:
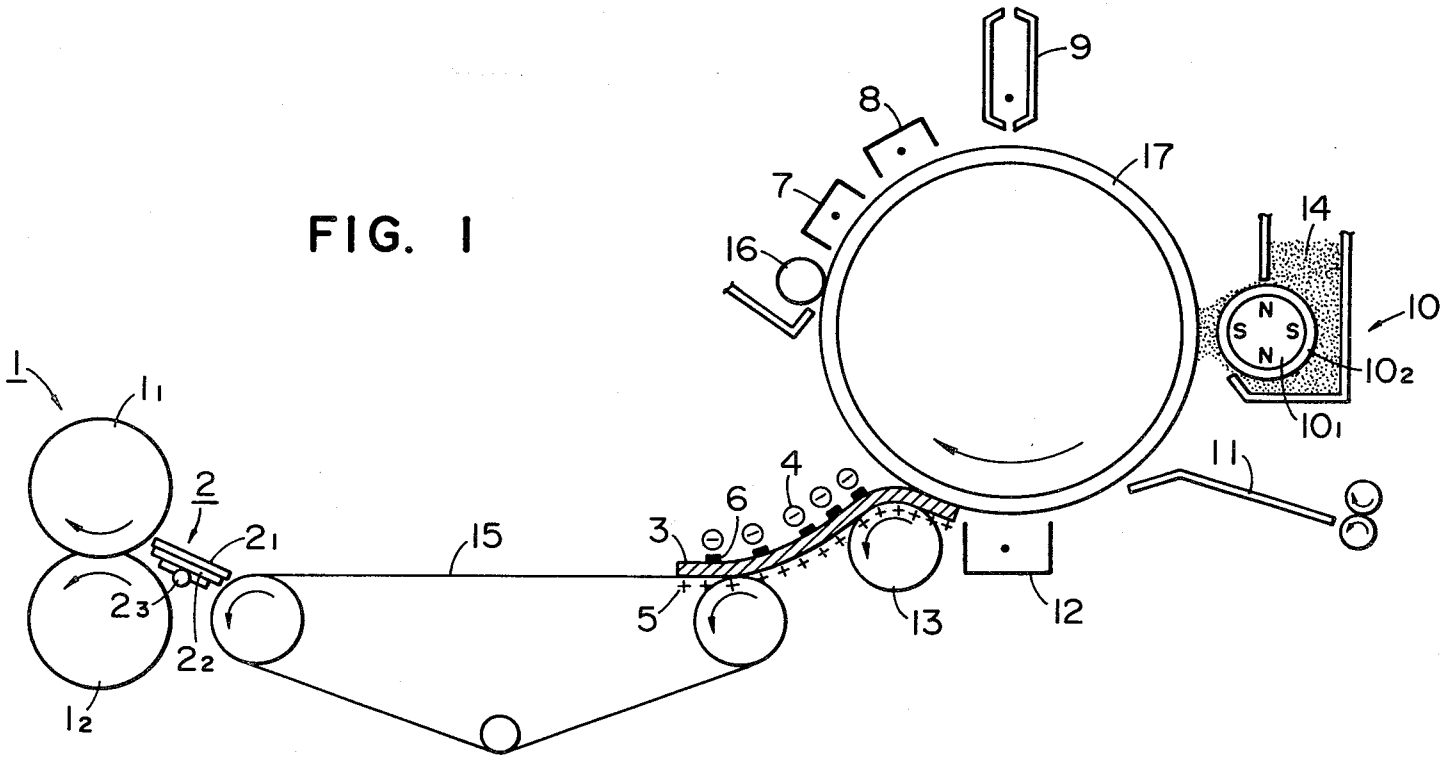
FIG. 1 is schematic view of an electrophotographic image recording apparatus embodying the present invention.

FIG. 1 illustrates an image-forming process in an electrophotographic apparatus constituting an example of the image recording apparatus adapted for embodying the present invention, and an embodiment of the present invention. In a fixing station 1, a fixing roller $1_1$ and a pressure roller $1_2$ are maintained in mutual pressure contact and rotated as indicated by arrows. In an image depositing station, a transfer charger 12 is positioned close to a photosensitive drum 17. A guide member 2, positioned closed to the fixing roller and maintained by support means $2_3$ at a determined angle with respect to the fixing roller $1_1$, is composed of a substrate $2_2$ and a coating material $2_1$ of a smaller surface resistivity than that of said substrate $2_2$.

As already known, the photosensitive drum 17 is rotated in the direction of arrow in response to a copy signal, and is subjected to preliminary charge elimination by a charge eliminator 7. Subsequently the photosensitive drum 17 is charged by a primary charger 8, then subjected to secondary charge elimination by a secondary charger 9 simultaneously with an imagewise exposure, and to a uniform exposure to form a positive latent image, which is developed into a visible image in a developing station 10. Said development can be achieved for example by transporting a one-component magnetic developer or toner 14 on a rotary sleeve $10_2$ in a state of magnetic brush caused by a magnet roller $10_1$ and causing said toner 14 to jump from said sleeve $10_2$ to the image area of said latent image at a position facing to the drum 17, or any other suitable developing method. In any case, the toner particles constituting the developer are negatively charged in case the surface potential of the image area is positive. A sheet 3 is guided on a guide plate 11 and is brought into contact with said drum 17 for receiving said visible image. The rear face of said sheet 3 is charged by a transfer charger 12 to a polarity opposite to that of the toner, whereby said visible image is transferred onto said sheet 3 and electrically borne thereon as an unfixed image 6. Thereafter the photosensitive drum 17 is cleaned by a roller 16 for the succeeding imaging cycle. On the other hand the sheet 3 bearing the unfixed image 6 is transferred by means of a roller 13 rotated in the direction of arrow onto a conveyor belt 15 rotated in the direction of arrow, on which said sheet 3 is closely adhered by the positive charge on the rear face thereof to said belt 15 and is advanced to the guide member without disturbance on the image 6. Thereafter the sheet 3 moves in friction contact with the coating layer $2_2$ of the guide member 2 and is guided between the paired rollers $1_1$, $1_2$ which perform the fixation of the unfixed image 6 onto the sheet 3 without perturbation in image.

Figure 2:
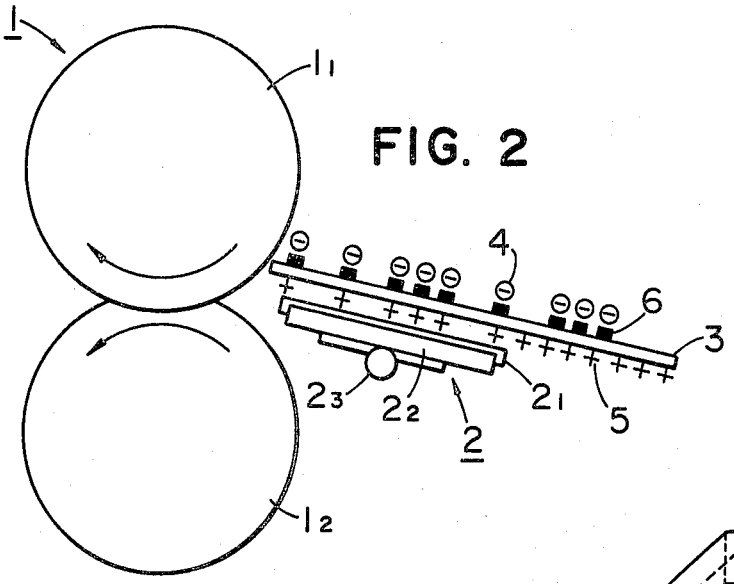
FIG. 2 is a lateral view showing an embodiment of the present invention.
Figure 3:
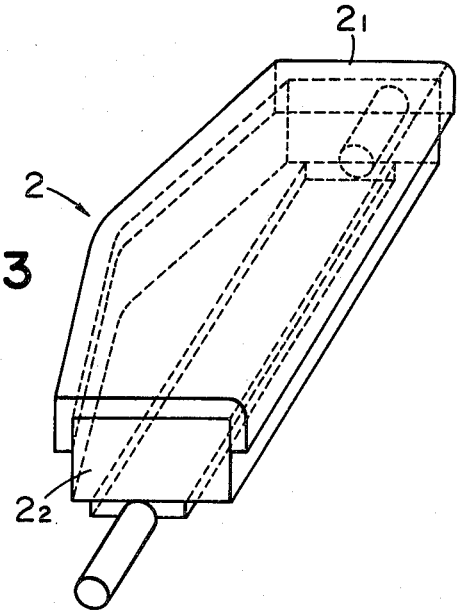
FIG. 3 is a perspective view showing an embodiment of the present invention.

Now reference is made to FIGS. 2 and 3 for further explanation on the process from the contact movement of the sheet 3 with the guide member 2 to the fixation of the unfixed image 6 thereon in the fixing station. The guide member 2 is preferably provided with a shape capable of preventing wrinkle formation. For example, as shown in FIG. 3, the guide member 2 of the present embodiment is so shaped that the front edge facing the paired rollers $1_1$, $1_2$ is extended more toward said paired rollers in the central portion than in the lateral portions. It is however to be understood that such structure is not necessarily essential.

As explained in the foregoing, said guide member 2 is composed of a substrate $2_2$ of a highly insulating material and a coating layer $2_1$ of a surface resistivity smaller than that of said substrate $2_2$. Said substrate $2_2$ is made highly insulating because, if it is made of a conductive material such as metal, the charge induced in said substrate by the charge present on the rear face of the image bearing member captures the charge from said rear face and accumulates said charge on the coating layer $2_1$, thus disturbing the image. However, if the guide member is made highly insulating to the surface thereof, the charge formed by friction with the image bearing member or given by the transfer charger to the rear face of the image bearing member is gradually accumulated on the surface of the guide member to eventually disturb the image. For this reason the guided member is coated, in a portion thereof coming into friction contact with the image bearing member, with a material of a lower surface resistivity than that of the substrate $2_2$, and such structure avoids the above-mentioned two drawbacks and allows gradual dissipation of the charge of the surface of the guide member, thus preventing excessive charge accumulation causing disturbance on the image.

Experimentally it is found that the substrate $2_2$ should have volume resistivity and surface resistivity respectively higher than $10^{10}\Omega$.cm and $10^{10}\Omega$. Also the coating $2_1$ should have surface resistivity in a range from $10^6\Omega$ to $10^9\Omega$. Even on a substrate $2_2$ satisfying the above-mentioned conditions, the coating $2_1$ tends to disturb the image by discharge to the image bearing member if the surface resistivity is smaller than $10^6\Omega$ or by excessive charge accumulation if the surface resistivity is larger than $10^9\Omega$. Such structure as providing the above-mentioned effect can be obtained for example by forming the substrate $2_2$ with an ABS, polycarbonate or phenolic resin in a shape having no sharp edge and surfacially coating said substrate with an antistatic agent such as Eleguard (Lion Yushi Co., Ltd.). Said antistatic agent can be composed of a quaternary ammonium salt such as Eleguard mentioned above, Elecdan (Taiyo Shokai) or Epicote-$\alpha$ (Chuo Package Kogyo), a nonnionic surfactant such as Elegan (Nippon Resin), a fluorinated anionic surfactant such as Florard (Sumitomo-3M), polystyrene sulfonate such as ER-P (Mitsubishi Chemical), or a quaternary ammonium polyvinylbutyral such as Achikamin (Asahi Denka) or Eslec (Sekisui Chemical).

Also said coating layer $2_1$ may be so provided as to cover the upper face and a part of the lateral faces of the substrate $2_2$ as illustrated, or to cover the substrate entirely or to form fine rods parallel to the direction of sheet advancement, as long as the above-mentioned surface resistivity is achieved.

Also said coating layer $2_1$ may be composed of a thin layer of an ABS, polycarbonate or phenolic resin mixed with carbon black or an organic pigment for achieving a lower resistivity, though the volume resistivity and the surface resistivity should preferably be not less than $10^6\Omega$.cm and $10^6\Omega$, respectively.

In summary, the foregoing embodiment is featured by a fact that a guide member for the transport of an image bearing member between an image depositing station and a fixing station is coated, at least in a portion thereof coming into contact with the image bearing member having an unfixed image thereof, with a layer of a lower surface resistivity than that of said guide member, thereby preventing disturbance in the image.

Figure 4:
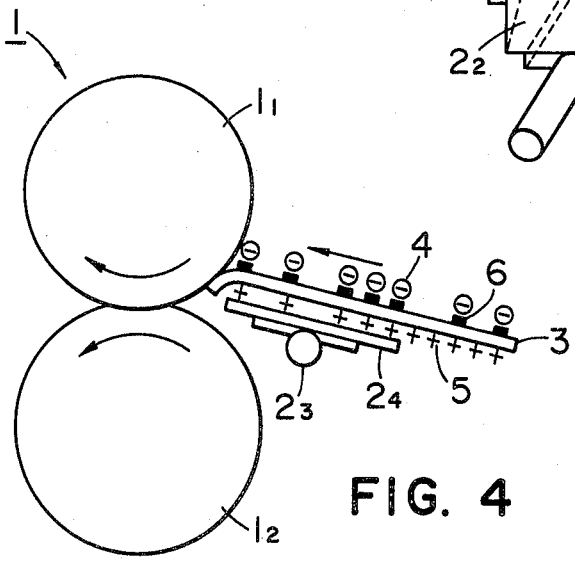
FIG. 4 is a lateral view showing another embodiment of the present invention.

Now reference is made to FIG. 4 showing another embodiment of the present invention, in which a guide member $2_4$ is positioned close to paired fixing rollers $1_1$, $1_2$ in a similar manner as the guide member 2 shown in FIG. 1 and is arranged at a determined angle by support means $2_3$ in such a manner that the front end thereof is positioned close to said fixing rollers. Said guide member $2_4$ is composed of a resin of a high resistivity mixed with a resistance-reducing material in order to gradually eliminate the excessive charge from the image bearing member 3 in friction contact with the guide member $2_4$, leaving on said bearing member a charge enough for bearing the unfixed image, and to gradually dissipate thus accumulated charge thus avoiding the accumulation thereof on the surface of the guide member. For example said mixture is provided with a volume resistivity not less than $10^6\Omega$.cm and a surface resistivity in a range from $10^6\Omega$ to $10^{11}\Omega$.

Said guide member $2_4$ is preferably provided with a shape effective for preventing wrinkles. For example, in the present embodiment, the guide member $2_4$ is provided with a front end facing the paired rollers $1_1$, $1_2$ more protruding in the center thereof than in the lateral parts thereof, but such shape is not necessarily essential.

Assuming that the unfixed image 6 is composed of negatively charged toner 4 in a similar manner as explained in the foregoing, the sheet 3 is provided on the rear pace thereof with positive charge 5 for bearing said unfixed image, and the image 6 is stabilized by said mutually opposite charges during the transfer of the sheet 3 from the belt 15 to the guide member $2_4$. In this state the sheet 3 is provided on the rear face thereof with positive charge 5 unbalancedly in excess of the negative charge 4 constituting the unfixed image 4, and as the sheet 3 slides over the guide member $2_4$, the positive charge 5 enough for maintaining the unfixed image is left on the rear face of the sheet 3 but the excessive charge and the frictional charge resulting from said sliding contact are gradually dissipated through the surface of the guide member $2_4$. The eliminated charge is accumulated on said surface and then gradually discharged through the guide member. Consequently, the sheet 3 becomes electrically well balanced and is subjected in this state to the image fixation by the fixing rollers $1_1$, $1_2$, thus providing a satisfactory image without image scattering.

As explained in the foregoing, the surface resistivity and the volume resistivity of the guide member are respectively selected in a range from $10^6\Omega$ to $10^{11}\Omega$ and in a range higher than $10^6\Omega$.cm because excessively low resistivities will cause rapid discharge of the charge 5 through the guide member $2_4$ involving the scattering of the unfixed image 6, while an excessively high surface resistivity will result in excessive accumulation of the charge 5 or the frictional charge resulting from the sliding contact on the surface of the guide member $2_4$, thus forming a field disturbing the image. The above-mentioned ranges have therefore been determined experimentally.

Such guide member as explained above can be formed for example by dispersing electroconductive carbon fibers into glass or a highly insulating polycarbonate, ABS or phenolic resin in such a manner as to obtain a surface resistivity in a range of $10^6\Omega$ to $10^{11}\Omega$, or by mixing a resistance-reducing material such a chromium dye or carbon black into a ceramic material such as $Al_2O_3$ ceramic material to obtain a similar surface resistivity. Said guide member can further be composed of glass which is desirable because of a relatively low surface resistivity in a range of $10^6\Omega$ to $10^9\Omega$ in relation to a relatively high volume resistivity in a range higher than $10^{15}\Omega$.cm, but in this case the guide member should preferably be provided with plural ribs on the surface in order to prevent the reduction in transportability in the presence of moisture.

In summary the above-mentioned guide member should be provided with a surface resistivity in a range from $10^6\Omega$ to $10^{11}\Omega$ and with a volume resistivity higher than $10^6\Omega$.cm. A preferred range for the surface resistivity is from $10^6\Omega$ to $10^9\Omega$, which is suitable also for use in a high-speed image forming apparatus. Another preferred embodiment can be achieved by reducing the surface resistivity in contrast to volume resistivity as observed in glass. Furthermore the guide member should preferably be electrically insulating as a whole. In the preparation of guide member, glass and resins are preferred because of the ease in working and of the dimentional stability.

In the following there will be explained experimental results on the effect of guide member made of glass, metal or phenolic resin on the unfixed image composed of a developer of very low particle coagulative force, in the apparatus shown in FIG. 1.

In the continuous copying with the metal guide member, the unfixed image of the image bearing member becomes disturbed upon passing over the guide member even from the first sheet, and is severely deteriorated after fixing.

In case of the guide member formed by a non-treated phenolic resin of a high resistivity, the image on the sheet is intact from the first sheet to the 8th or 10th sheet, but the sheets thereafter are attracted to the guide member during transportation and show disturbed images. Also in case of a large-sized sheet, for example an A3 sheet, it is observed that the image in the latter half of the sheet is scattered to deteriorate the image quality.

In contrast to the foregoing, the glass guide member provides satisfactory images without scattering even in continuous copying in excess of 100 sheets.

These experiments indicate that the guide member made for example of glass and having a volume resistivity higher than $10^6\Omega$.cm and a surface resistivity in a range from $10^6\Omega$ to $10^{11}\Omega$ is superior to the guide members made of metal or phenolic resin.

In summary the foregoing embodiment is featured by a fact that a guide member for the transport of an image bearing member between an image depositing station and a fixing station is provided with a volume resistivity higher than $10^6\Omega$.cm and a surface resistivity in a range from $10^6\Omega$ to $10^{11}\Omega$.

Figure 5:
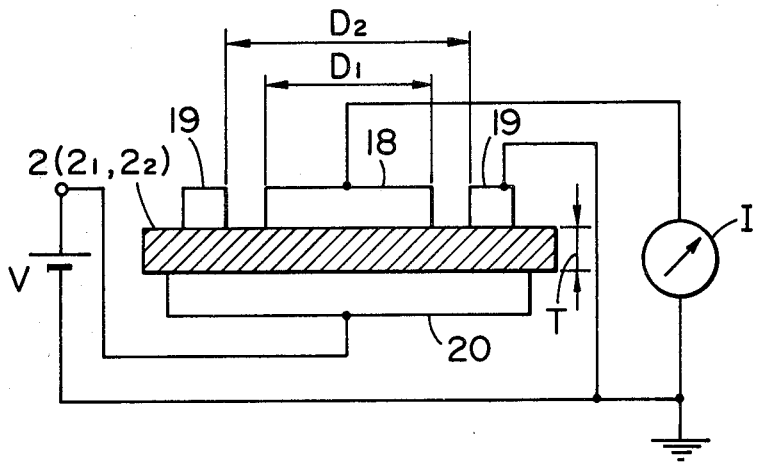
FIG. 5 is a schematic view showing the principle of volume resistivity measurement of a guide member embodying the present invention.
Figure 6:
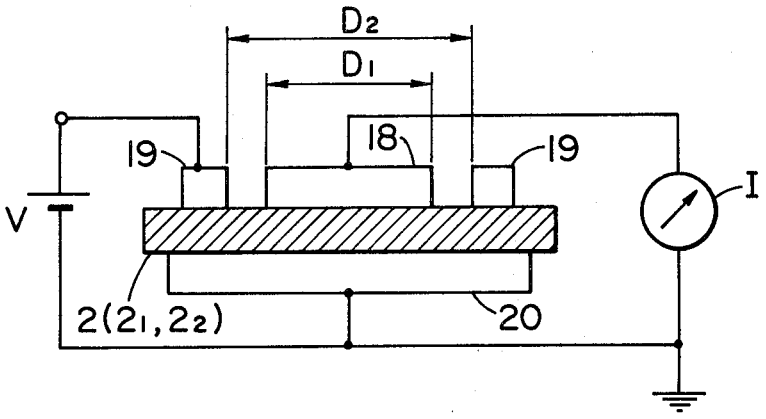
FIG. 6 is a schematic view showing the principle of surface resistivity measurement of a guide member embodying the present invention.

The aforementioned volume resistivity and surface resistivity can be measured with a volume resistivity measuring circuit as shown in FIG. 5 and with a surface resistivity measuring circuit as shown in FIG. 6. In these circuits the guide member is sandwiched between a principal electrode 18 and a counter electrode 20, and a voltage source V and an ammeter I as shown in FIGS. 5 and 6. In order to avoid the current entering the ammeter I through the surface of the guide member an annular electrode 19 is placed around the principal electrode and is connected to the ground line of the voltage source V.

In this manner the volume resistivity $R_1$ is determined by the following equation:

$$R_1 = \frac{V}{I} \frac{\pi D_1^2}{4} \frac{1}{t} (\Omega \cdot cm)$$

wherein t: guide member thickness $D_1$: diameter of the principal electrode

I: current in guide member, and the surface resistivity $R_2$ is determined by:

$$R_2 = \frac{V}{I} \frac{\pi(D_2 + D_1)}{D_2 - D_1} (\Omega)$$

wherein $D_1$: diameter of principal electrode $D_2$: internal diameter of high-voltage electrode.

In the foregoing embodiments the present invention is applied to a guide member in consideration of the transportability of the sheet 3 on the conveyor belt, but it is naturally applicable also to other transport members. Also in the foregoing embodiments description has been made on certain developing method, developer, image bearing member and fixing method, but the present invention is by no means limited to these parameters and is applicable to any image recording apparatus in which a transport member comes into contact with an image bearing member electrically bearing an unfixed image thereon.

As explained in the foregoing, the present invention is featured by an image forming apparatus provided with an image depositing station for causing an image bearing member to bear an unfixed image, a fixing station for fixing said unfixed image onto said image bearing member, transport means contributing to the transport of said image bearing member between said image depositing station and said fixing station, and support means for supporting said transport means, wherein said transport member is provided with a first resistivity in a first part thereof and with a second resistivity in a second part thereof coming into contact with said image bearing member in such a manner as not to disturb said unfixed image during the transport of said image bearing member on said transport member, and is capable of completely preventing the scattering of the unfixed image present on the image bearing member, thereby avoiding the smear in the image forming apparatus resulting from thus scattered image, and allows to reduce the distance between the guide member and the fixing rollers thus preventing the wrinkle formation on the image bearing member.

What we claim is:

1. An image recording apparatus, comprising:

an image depositing station for providing an unfixed image on an image bearing member;

a fixing station for fixing the unfixed image on the image bearing member; and a guiding member for guiding the image bearing member from said image depositing station to said fixing station, said guiding member including a portion which is slidingly contactable with the image bearing member and a portion which is not contactable therewith;

wherein said non-contact portion has a first resistivity, and said contact portion has a second resistivity which is lower than the first resistivity.

2. An apparatus according to claim 1, wherein said guiding member includes a substrate and a coating thereon, which coating forms said contact portion having the second resistivity.

3. An apparatus according to claim 2, wherein said substrate forms said non-contact portion having the first resistivity.

4. An apparatus according to claim 3, wherein said first resistivity is the surface resistivity of said substrate, and said second resistivity is the surface resistivity of said coating.

5. An apparatus according to claim 4 wherein the first resistivity is not less than $10^{10}\Omega$, and the second resistivity is not more than $10^9\Omega$.

6. An apparatus according to claim 5, wherein the second resistivity is not less than $10^6\Omega$.

7. An apparatus according to claim 3, wherein the first resistivity is the volume resistivity of said substrate, and said second resistivity is the surface resistivity of said coating.

8. An apparatus according to claim 7, wherein the first resistivity is not less than $10^{10}\Omega$.cm, and the second resistivity is not more than $10^9$.

9. An apparatus according to claim 8, wherein the second resistivity is not less than $10^6\Omega$.

10. An apparatus according to any one of claims 2 to 9, wherein said substrate is molded from at least one material selected from the group consisting of ABS resins, polycarbonate resins and phenolic resins, and said coating is composed of an antistatic material.

11. An apparatus according to claim 10 wherein the antistatic material constituting said coating is composed of at least one material selected from the group consisting of quaternary ammonium salts, nonionic surface active agents, fluorinated anionic surface active agents, polystyrenesulfonates, quaternary ammonium acrylic polymers, and quaternary ammonium polyvinyl butyral.

12. An apparatus according to any one of claims 2 to 9, wherein said substrate is molded from at least one material selected from the group consisting of ABS resins, polycarbonate resins, and phenolic resins, and said coating is composed of a mixture of a high-resistivity material and a resistance-reducing material.

13. An apparatus according to claim 12, wherein said coating is composed of at least one member selected from ABS resins, polycarbonate resins and phenolic resins mixed with at least one member selected from carbon black and organic dyes.

14. An image recording apparatus, comprising:

an image depositing station for providing an unfixed image on an image bearing member;

a fixing station for fixing the unfixed image on the image bearing member; and a guiding member for guiding the image bearing member from said image depositing station to said fixing station, said guiding member including a portion which is slidingly contactable with the image bearing member and a portion which is not contactable therewith;

wherein said contact portion has a surface resistivity which is lower than the volume resistivity of said guiding member, to prevent disturbance to the unfixed image during transport of the image bearing member along the contact portion of said guiding member.

15. An apparatus according to claim 14, wherein the surface resistivity of said guiding member is not less than $10^6\Omega$ but not more than $10^{11}\Omega$, and the volume resistivity thereof is not less than $10^6\Omega$.cm.

16. An image recording apparatus according to claim 14 or 15, wherein said guiding member is composed of a glass material.

17. An image recording apparatus according to claim 14 or 15, wherein said guiding member is composed of a high-resistivity material mixed with a resistance-reducing material.

18. An image recording apparatus according to claim 17, wherein said resistance-reducing material of said guiding member comprises at least one member selected from the group of electroconductive materials and organic dyes.

19. An image recording apparatus according to claim 18, wherein said transport member is composed of at least one material selected from the group consisting of glasses, polycarbonate resins, ABS resins, phenolic resins, ceramics and $Al_2O_3$ ceramics, mixed with at least a material selected from the group consisting of carbon fibers, chromium dyes and carbon black.

20. An apparatus according to claim 1 or 14, wherein said guiding member is disposed adjacent to and upstream of a pair of rollers of said fixing station, and fixedly mounted to guide the image bearing member to said fixing rollers.

* * * * *